US011407630B1

(12) United States Patent
Shafir

(10) Patent No.: US 11,407,630 B1
(45) Date of Patent: Aug. 9, 2022

(54) ON DEMAND FUNCTIONAL BEVERAGE DISPENSER

(71) Applicant: Smart Soda Holdings, Inc., Beachwood, OH (US)

(72) Inventor: Lior Shafir, Beachwood, OH (US)

(73) Assignee: Smart Soda Holdings, Inc., Beachwood, OH (US)

( * ) Notice: Subject to any disclaimer, the term of this patent is extended or adjusted under 35 U.S.C. 154(b) by 0 days.

(21) Appl. No.: 17/190,665

(22) Filed: Mar. 3, 2021

(51) Int. Cl.
*B67D 1/00* (2006.01)
*B67D 1/08* (2006.01)

(52) U.S. Cl.
CPC ..... *B67D 1/0034* (2013.01); *B67D 1/0888* (2013.01)

(58) Field of Classification Search
CPC ..... B67D 1/0034; B67D 1/0888
See application file for complete search history.

(56) References Cited

U.S. PATENT DOCUMENTS 7,648,050 B1 * 1/2010 Ehlers ..... G07F 13/06 222/129.4
8,162,176 B2 * 4/2012 Rudick ..... B67D 1/0888 222/1
8,434,642 B2 * 5/2013 Rudick ..... B67D 1/0888 222/1
9,051,162 B2 * 6/2015 Peters ..... B67D 1/0888
10,301,583 B2 * 5/2019 Schuh ..... A23L 2/56
10,631,558 B2 * 4/2020 White ..... A23L 2/52
2008/0054837 A1 * 3/2008 Beavis ..... F04B 49/065 318/696
2009/0069933 A1 * 3/2009 Rudick ..... B67D 1/0877 700/239
2009/0159612 A1 * 6/2009 Beavis ..... A47J 31/36 222/52
2011/0315711 A1 * 12/2011 Hecht ..... A47J 31/52 222/129.1
2012/0055954 A1 * 3/2012 Hecht ..... B67D 1/0043 222/129.1
2013/0292407 A1 * 11/2013 Beavis ..... F04B 13/00 222/1
2014/0326754 A1 * 11/2014 Hecht ..... G06F 3/041 222/192
2015/0014357 A1 * 1/2015 Beavis ..... B67D 1/0888 222/129.1
2015/0191341 A1 * 7/2015 Martindale ..... B67D 1/0888 222/1
2016/0092931 A1 * 3/2016 Cuppari ..... G06Q 30/0269 705/14.66
2017/0233234 A1 * 8/2017 Hecht ..... B67D 1/0021 222/129.1

* cited by examiner

*Primary Examiner* — Frederick C Nicolas
(74) *Attorney, Agent, or Firm* — Renner, Otto, Boisselle & Sklar, LLP

(57) ABSTRACT

An on demand functional beverage dispenser is provided that outputs an enhanced flavored mixture by combining a liquid with a flavored product and a functional product including a dietary supplement.

18 Claims, 5 Drawing Sheets

ON DEMAND FUNCTIONAL BEVERAGE DISPENSER

FIELD OF INVENTION

The present invention relates to a beverage dispenser and more particularly to system for controlling a beverage dispenser by adding flavored products and functional products to a liquid.

SUMMARY

In a general embodiment, the present disclosure provides an on demand functional beverage dispenser that outputs an enhanced flavored mixture by combining a liquid with a flavored product and a functional product including a dietary supplement.

While a number of features are described herein with respect to embodiments of the invention; features described with respect to a given embodiment also may be employed in connection with other embodiments. The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention in which similar reference numerals are used to indicate the same or similar parts in the various views.

Figure 3:
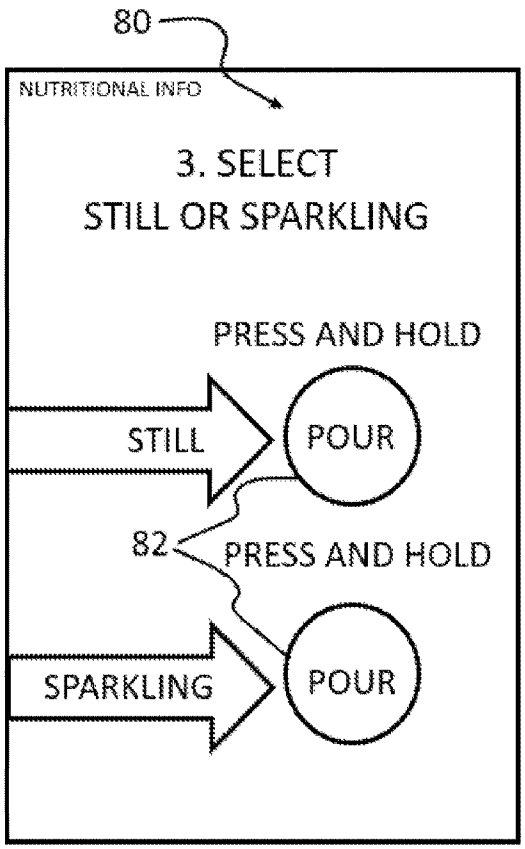
FIG. 3 is an exemplary embodiment of a user interface of the beverage dispenser for selecting a water type.

The present invention is described below in detail with reference to the drawings. In the drawings, each element with a reference number is similar to other elements with the same reference number independent of any letter designation following the reference number. In the text, a reference number with a specific letter designation following the reference number refers to the specific element with the number and letter designation and a reference number without a specific letter designation refers to all elements with the same reference number independent of any letter designation following the reference number in the drawings.

DETAILED DESCRIPTION

The principles described herein may be used in beverage dispensing applications. Exemplary applications include beverage dispensing machines for providing an on demand functional beverage. The principles described herein may be sized down for use in home beverage dispensers or sized up for use in industrial beverage dispensers. Many different flavors and liquids may be suitable for use with the beverage dispensing machine and control system described herein. Exemplary beverages (also referred to as flavored mixtures) include any suitable combinations of water, carbonated water, alkaline water, syrup, soda, other carbonated beverages, tea, coffee, and powders or solutions of flavored products and functional products.

The beverage dispensers, systems, and methods described herein are advantageous in producing a functional flavored beverage mixture/solution based on user instructions.

Figure 2:
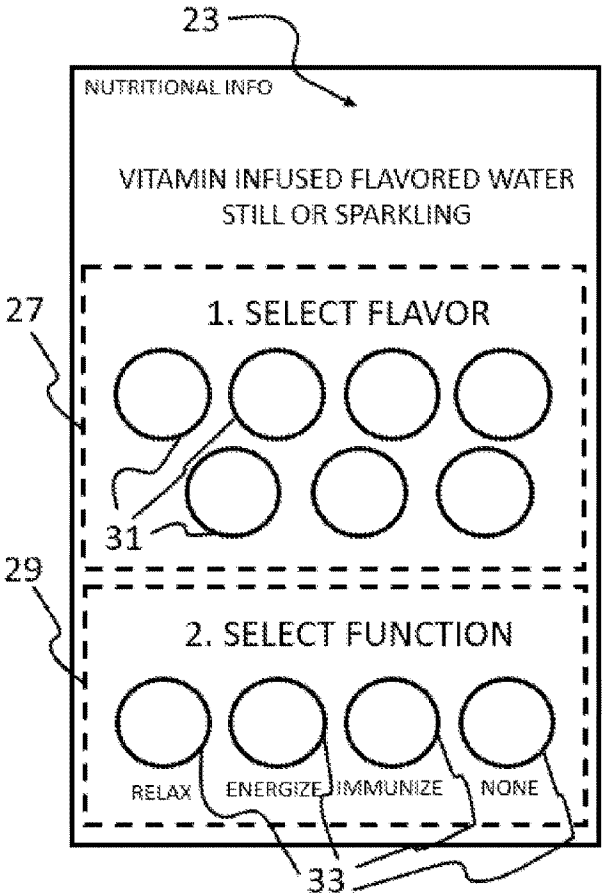
FIG. 2 is an exemplary embodiment of a user interface of the beverage dispenser for selecting a flavor and function.
Figure 1:
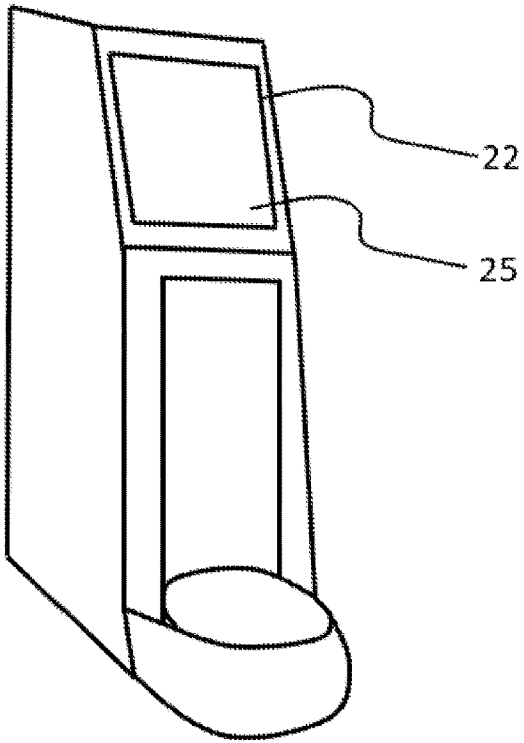
FIG. 1 is an exemplary embodiment of a beverage dispenser.
Figure 4:
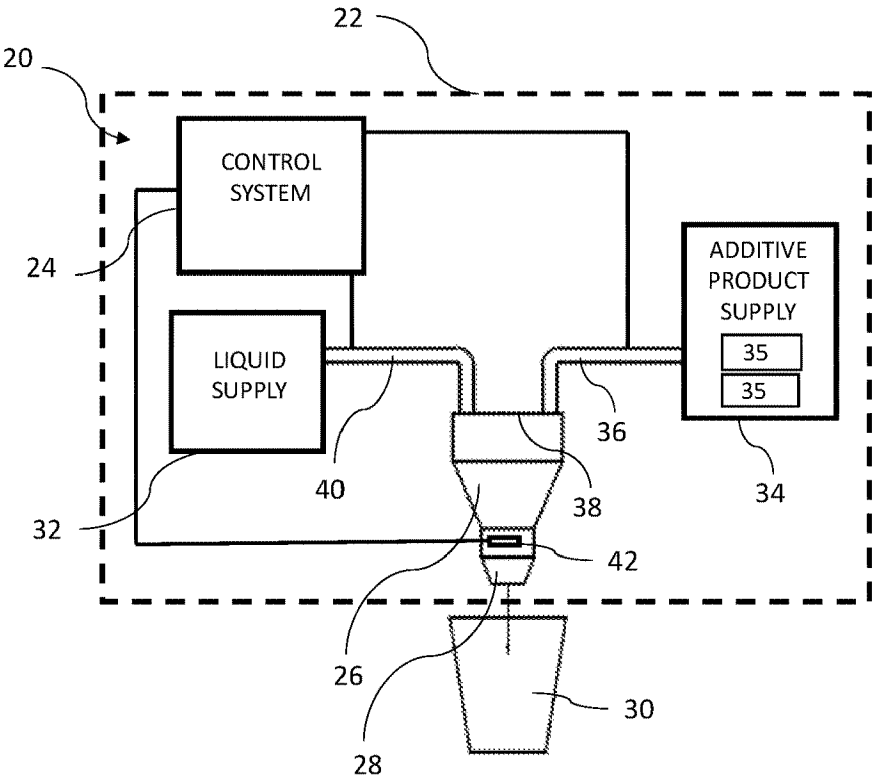
FIG. 4 is a schematic drawing showing an exemplary embodiment of a beverage dispenser and a control system.

Turning to FIG. 1, an exemplary beverage dispenser 22 having a display 25 is shown. In FIGS. 2 and 3, an exemplary user interface 23 for controlling the beverage dispenser 22 is shown. Referring first to FIG. 4, a beverage dispensing system 20 including a beverage dispenser 22 and a control system 24 is schematically shown.

In one embodiment, the beverage dispenser 22 includes a mixing receptacle 26 in which an enhanced flavored mixture is formed and a mixture outlet 28 from which the enhanced flavored mixture is dispensed out of the beverage dispenser 22. As used herein, the term "mixture" is not limited to liquid mixtures in which substances are not completely dissolved. Likewise, "solution" is not limited to liquid mixtures in which substances are completely dissolved. For example, the enhanced flavored mixture may be dispensed into any suitable container 30 for consumption by a user.

The mixing receptacle 26 is fluidly connected to a liquid enclosure 32 containing a supply of liquid and a product enclosure 34 containing a supply of flavored product. The liquid from the liquid enclosure 32 and the additive product(s) from the product enclosure 34 (also referred to as additive product supply) are supplied to the mixing receptacle 26 where the materials, or ingredients, are mixed to produce the enhanced flavored mixture. The mixing receptacle 26 may include any suitable components for blending, emulsifying, homogenizing, or otherwise mixing materials into a single substance. Exemplary components include paddles, blades, or beaters that are motorized.

Alternatively, mixing may be accomplished by controlled injection of the flavored product while dispensing the supply of liquid. The amount of injected additive product (e.g., functional product and flavor product), amount of liquid supply, and the flow of the liquid supply may dictate the manner and rate at which the additive product are injected.

The product enclosure 34 is arranged in the beverage dispenser 22 and may be configured to receive, retain, and supply any suitable additive product to the mixing receptacle 26. In the embodiment shown in FIG. 4, the product enclosure 34 includes multiple selectable reservoirs 35. Each of the reservoirs 35 contain one of the additive products separately from the liquid. The additive products include both flavored products and functional products. For example, the product enclosure (also referred to as the additive product supply) may contain a plurality of flavored products and a plurality of functional products. In an exemplary embodiment, the beverage dispenser 22 includes a total of ten additive products. For example, there may be six flavored products and four functional products or seven flavored products and three functional products. Each of the additive products may be stored in a separate selectable reservoir 35.

The product enclosure 34 also includes an additive control valve 54 that is configured to control release of the additive products from the multiple reservoirs 35. The additive control valve 54 is fluidly connected to the mixing receptacle 26 for mixing at least one of the additive products with the liquid to form an enhanced flavored mixture that is dispensed from the mixture outlet 28 and the mixture control valve 42.

In the embodiment shown in FIG. 2, the circuitry 48 of the control system 24 causes the display 25 to display the user interface 23. The user interface 23 has a flavor selection area 27 and a function selection area 29. The flavor selection area 27 includes multiple selectable flavors 31. The function selection area 29 includes multiple selectable functions 33. (While the function and flavor selection areas 27, 29 are shown as being separated in FIG. 2, the function and flavor selection areas may overlap.) A user inputs a requested flavor (i.e., the selected flavor) and a requested function (i.e., the selected function). The circuitry 48 receives the selected flavor and the selected function from the display 25. The circuitry 48 then chooses from the multiple selectable reservoirs 35 a flavor reservoir based on the selected flavor. The circuitry 48 also chooses from the multiple selectable reservoirs 35 a function reservoir based on the selected function. For example, each of the selectable flavors 31 and each of the selectable functions 33 may be associated with one of the multiple selectable reservoirs 35. Consequently, when a selected flavor is received, the circuitry 48 may choose as the flavor reservoir the reservoir 35 that is associated with the selected flavor (e.g., using a lookup table). Similarly, when a selected function is received, the circuitry 48 may choose as the function reservoir the reservoir 35 that is associated with the selected function.

While each of the selectable flavors 31 and selectable functions 33 are described above as associated with one of the multiple reservoirs, any of the selectable flavors 31 or selectable functions 33 may be associated with two or more of the selectable reservoirs 35. Consequently, the function reservoir (and/or the flavor reservoir) may be a combination of two or more of the reservoirs 35.

Different flavored products (e.g., syrups) may be suitable, including flavors such as cola, diet cola, root beer, ginger ale, lemon lime, orange, ginger beer, black cherry, raspberry, grapefruit, strawberry, etc. Similarly, different functions may be suitable. For example, the selectable functions 33 may include at least one of relax, energize, immunize, or muscle. In the embodiment shown in FIG. 2, the functions include relax, energize, and immunize.

The selectable functions may result in the additional of different dietary supplements being added to the liquid. In an embodiment, adding the selectable function to the liquid results in dietary supplements being added to the liquid that are understood to be associated with the selected function. For example, when the selected function is relax, the circuitry 48 may be choose as the function reservoir one of the multiple selectable reservoirs 35 including at least one of cannabidiol (CBD), *Rhodiola rosea*, melatonin, glycine, ashwagandha, L-theanine, B vitamins, or kava. Similarly, when the selected function is energize, the circuitry 48 may choose as the function reservoir one of the multiple selectable reservoirs 35 including at least one of caffeine, coenzyme Q10 (CoQ10), B vitamins, iron, creatine, citrulline, *Rhodiola rosea*, or ashwagandha. When the selected function is immunity, the circuitry 48 may choose as the function reservoir one of the multiple selectable reservoirs 35 including at least one of vitamin C, B vitamins, vitamin E, vitamin A, vitamin D, folate, folic acid, iron, selenium, zinc, elderberry, echinacea. When the selected function is muscle, the circuitry 48 may choose as the function reservoir one of the multiple selectable reservoirs 35 including at least one of protein, amino acids, or creatine.

In some embodiments, the flavored products may also include the dietary supplement included in the functional products. For example, the functional product for immunize may include vitamin C. Similarly, a flavored product for orange may similarly include vitamin C. However, the concentration of vitamin C in the functional product may be larger than the concentration of vitamin C in the flavored product. For example, the concentration of the dietary supplement included in the selected function that is included in the enhanced flavored mixture may be at least five times larger or at least ten times larger than a concentration of the dietary supplement included in the selected flavor that is included in the enhanced flavored mixture. In this example, the amount of vitamin C added by the selected function to the liquid may be at least five or ten times larger than the amount of vitamin C added by the selected flavor.

In another embodiment, the selected function included in the enhanced flavored mixture includes a dietary supplement in a quantity that is greater than or equal to 50% of a daily Recommended Dietary Allowances (RDA) for the dietary supplement. In other embodiments, the selected function may include at least 100%, at least 200% or at least 500% of the daily RDA for the dietary supplement.

The circuitry 48 causes the beverage dispenser 22 to generate an enhanced flavored mixture by adding to a liquid the selected flavor from the flavor reservoir and the selected function from the function reservoir. The circuitry 48 then causes the beverage dispenser to dispense the enhanced flavored mixture.

The enclosure 34 may be configured to store the additive products (i.e., flavored products and functional products) until use and the enclosure 34 may have any suitable shape and capacity, which may be dependent on the application and the type of flavored. The product enclosure 34 may have any suitable inlet for receiving the powder or liquid comprising the additive products and a supply line 36 may be fluidly connected between the product enclosure 34 and the mixing receptacle 26.

Other devices may be provided to transport the additive products to the mixing receptacle 26 and the devices used may be dependent on whether the product is in powder form or liquid form. Various pumps, valves, motors, and/or pneumatic devices may be arranged along the supply line 36 to move the flavored product along the supply line 36 toward the mixing receptacle 26. The mixing receptacle 26 may be oriented substantially vertically with the supply line 36 and the product enclosure 34 arranged at an upper end 38 of the mixing receptacle 26 such that the flavored product may be assisted by gravity in entering the mixing receptacle 26.

Similarly, the liquid enclosure 32 may also arranged in the beverage dispenser 22 and may also be arranged at the upper end 38 of the mixing receptacle 26 for receiving, retaining, and supplying the liquid to the mixing receptacle 26. The liquid enclosure 32 may be arranged independently from the product enclosure 34 to store or hold the liquid and the additive product separately prior to mixing. Separately containing the materials is advantageous in that the shelf life of the products may be longer prior to mixing. Still another advantage is that the bulk of the materials is separated and the materials may be incrementally mixed to ensure a precise mixture and avoid undesired ratios of flavored to liquid.

A supply line 40 may be fluidly connected between the liquid enclosure 32 and arranged at the upper end 38 of the mixing receptacle 26 such that gravity assists in moving the liquid to the mixing receptacle 26 for mixing with the additive product. The supply lines 36, 40 used in the beverage dispenser 22 may include any suitable hoses, tubing, and fluid connectors configured for fluid transport. In other embodiments, various pumps, valves, motors, and/or pneumatic devices may be arranged along the supply line 40 to move the liquid toward the mixing receptacle 26. Any suitable liquid may be used and examples of suitable liquids include water, alkaline water, carbonated water, and/or carbonated water that is made with alkaline water. In addition, the liquid may be carbonated at the mixing receptacle, and may have a separate carbonation supply and supply line (not shown) to the mixing receptacle.

In the embodiment shown in FIG. 3, the display 23 displays a water selection user interface 80 for selecting the liquid. The water selection user interface 80 includes multiple selectable water types 82. The water selection user interface 80 may be displayed after the user selects a flavor and a function (e.g., using the user interface 25 displayed in FIG. 2). The selectable water types 82 may include sparkling water and still water as shown in FIG. 3.

The control system 23 may control the liquid control valve 52 and the additive control valve 54 to modulate an amount of the selected flavor from the flavor reservoir and the selected function from the function reservoir in the dispensed flavored mixture based on the received beverage selections.

During mixing of the liquid and the additive products, the control system 24 controls the amount of the selected flavor and the amount of the selected function that is mixed in the liquid. The control system 24 may advantageously provide more precise control of amount of the flavored product that is mixed to ensure desired ratios of the flavored product(s) to the liquid. The control system 24 is communicatively coupled with a mixture control valve 42 that is arranged in the mixture outlet 28 of the mixing receptacle 26. The mixture control valve 42 may be opened, closed, or partially opened or closed by the control system 24 to meter the flavored product being mixed into the liquid prior to dispensing the formed enhanced flavored mixture from the mixture outlet 28. The control system 24 may also be communicatively coupled with the supply lines 36, 40 to control the supply of the liquid and the flavored product supply into the mixing receptacle 26. For example, additional control valves may be arranged along the supply lines 36, 40.

Any suitable electronic lines, wiring, cables, harnesses, etc. may be used to connect the control system 24 with the corresponding components of the beverage dispenser 22 and the control system 24 may be automated. Automating the operation enables the control system 24 to maintain a predetermined amount of the flavored product in the dispensed enhanced flavored mixture during continuous operation. The predetermined amount may be dependent on the desired beverage product and the solubility of the flavored product within the liquid.

Figure 5:
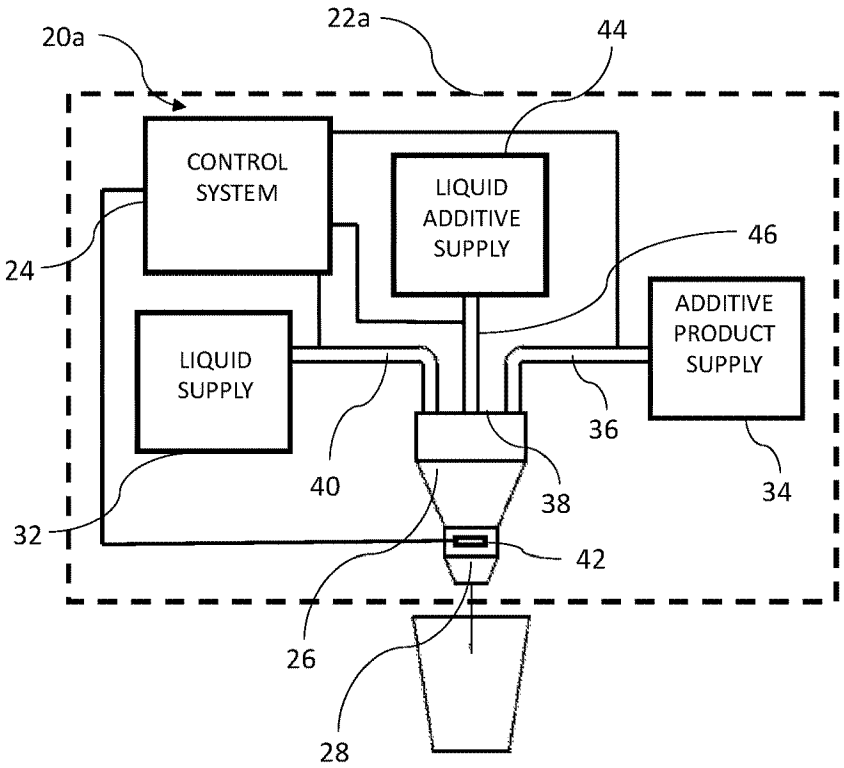
FIG. 5 is a schematic drawing showing the beverage dispenser and the control system of FIG. 4 according to another exemplary embodiment including a liquid additive supply.

Referring in addition to FIG. 5, another exemplary embodiment of the beverage dispensing system **20*a* is shown in which the beverage dispenser 22*a* further includes a liquid additive enclosure 44 that is fluidly connected to the mixing receptacle 26, such as via a supply line 46, for supplying a liquid additive that is mixed with the liquid and the flavored product to form the enhanced flavored mixture. The liquid additive enclosure 44 is configured to receive, contain, and supply the liquid additive separately from the product enclosure 34 and the liquid enclosure 32. Like the product enclosure 34 and the liquid enclosure 32, the liquid additive enclosure 44 and supply line 46 may be arranged at the upper end 38 of the mixing receptacle 26. The mixture outlet is arranged at the bottom of the mixing receptacle 26 opposite the supply lines 36, 40, 46**.

Using the liquid additive is advantageous in that further variations of beverage products may be produced by the beverage dispenser **22*a*. The control system 24 of the beverage dispensing system 20*a* may also be communicatively coupled to the supply line 46 for controlling the amount of liquid additive added to the enhanced flavored mixture. A control valve may be arranged along the supply line 46 and communicatively coupled with the control system 24. Accordingly, all of the supply lines 36, 40, 46 may be independently controlled by the control system 24 to achieve a desired enhanced flavored mixture. In an exemplary embodiment, the control system 24 may be used to close the supply line 46 for the liquid additive such that the beverage dispenser 22*a* may operate using only the liquid enclosure 32 and the product enclosure 34 as in the beverage dispenser 22 shown in FIG. 4**.

Any suitable liquid additive may be used in the beverage dispensing system **20*a*. Exemplary liquid additives include syrup, soda, vitamin infused liquids, and combinations thereof. The beverage dispensing systems 20, 20*a*** may be capable of outputting enhanced flavored mixtures that include alkaline water, carbonated water made with alkaline water, carbonated water made with alkaline water and vitamin infused soda or sparkling water, and variations thereof. The vitamin infused soda or flavored sparkling water may include a complex vitamin B and C. Liquid additives may include sweeteners such as sucralose or organic cane sugar. Still many other enhanced flavored mixtures may be suitable.

In an exemplary embodiment, the product enclosure 34 may include a bag-in-box type configuration in which each of the flavored product(s) is pre-mixed with a fluid prior to being supplied to the mixing receptacle 26 for mixing with the liquid. The flavored product may be a syrup or any suitable fluid.

Figure 6:
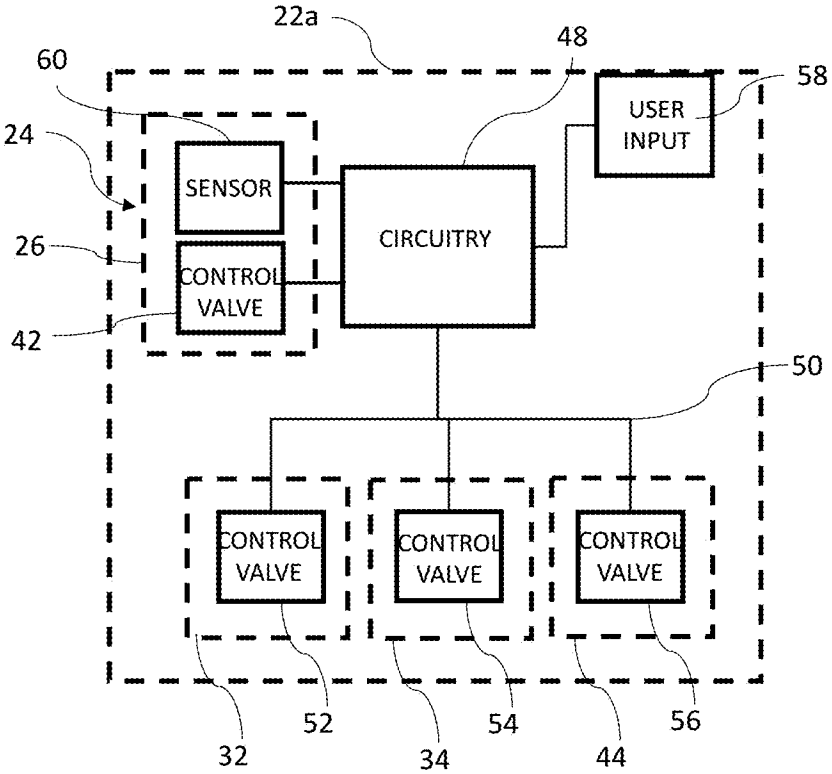
FIG. 6 is a schematic drawing showing the control system of FIG. 5.

Referring now to FIG. 6, an exemplary embodiment of the control system 24 for the beverage dispenser **22*a* is shown. As described above, the control system 24 includes circuitry 48 (e.g., a processor) and a controller 50 communicatively coupled to the circuitry 48. The control system 24 may include any suitable electronic control mechanism, such as, for example, a central processing unit (CPU), a microprocessor, control circuitry, and other suitable components. The controller 50 may be communicatively coupled between the circuitry 48 and control valves 52, 54, 56 that correspond to the liquid enclosure 32, the product enclosure 34, and the liquid additive enclosure 44, respectively. The control valves 42, 52, 54, 56** may have any suitable configuration or components to directly control the flow rate. The control valves may be rotary, having balls, butterfly or plug type closures, or linear, having globe, diaphragm or pinch type closures. Any suitable type of actuator may be used for the valves, such as a piston or diaphragm that is pneumatic, electric, or a combination thereof. Electromechanically operated valves including solenoid valves may also be suitable. Many other types of control valves may be suitable.

The circuitry 48 is configured to provide instructions to the controller 50 to adjust the control valves 52, 54, 56 for controlling amounts of the liquid, flavored product(s), and liquid additive during mixing. As described above, the beverage dispenser 22 receives user input from the display 23. The display may be any suitable device for displaying information and receiving user input (e.g., a touch-screen). The processor 48 may be configured to operate the controller 50 and the control valves 42, 52, 54, 56 based on the user input 58. For example, the user input 58 may be used to selectively add the liquid additive and/or flavored product based on the user's preference.

As opposed to receiving instructions from the display 23, the control system 24 may be configured to also receive instructions from a mobile device via a communication interface. The communication interface may be connected to the mobile device via a wireless connection and receives instructions from the mobile device. The received instructions may include the selected flavor and the selected function.

The communication interface may be communicatively coupled to the control system and identify the selected flavor and the selected function. The communication interface may receive instructions from a mobile device. In particular, the communication interface may be in wireless communication with a network interface of the mobile device. The communication interface may comprise a wireless network adaptor, an Ethernet network card, a near field communication (NFC) antenna, or any suitable device that provides an interface between the communication interface of the beverage dispenser and the network interface of the mobile device. The communication interface may additional communicate with a server via a network such as the internet, such that the communication interface is able to send data stored on a computer readable medium of the beverage dispenser across the network and store received data on the computer readable medium (e.g., data based on the instructions received from the mobile device). As described above, the communication interface is also communicatively coupled to the control system such that the control system is able to control operation of the beverage dispenser based on instructions received by the communication interface. The communication interface, computer readable medium, and circuitry may be communicatively coupled through a system bus, mother board, or using any other suitable manner as will be understood by one of ordinary skill in the art.

The beverage dispenser 22 and the mobile device may communicate using a wireless signal having a limited effective distance. For example, the beverage dispenser 22 and the mobile device may communicate using a protocol having a maximum effective distance of two feet or less (e.g., NFC) such that a user does not mistakenly cause a beverage dispenser 22 to dispense a beverage when the user is across the room from the beverage dispenser 22.

The beverage dispenser 22 may include a volume sensor configured to measure a volume of fluid dispensed by the beverage dispenser 22. The volume sensor may be any suitable sensor for determining a dispensed volume of fluid. For example, the volume sensor may be a flow sensor and the output of the flow sensor may be used to determine a dispensed volume over a period of time. As another example, the volume sensor may be implemented by the processor and may estimate the dispensed volume based on the time that fluid was dispensed by the beverage dispenser 22 based on a known flow rate of the beverage dispenser 22.

The beverage dispenser 22 may be configured to communicate with a server via the communication interface. For example, the beverage dispenser 22 may communicate with the server over a network such as the internet. The beverage dispenser 22 may communicate to the server 25 the user ID and at least one of the measured volume or the at least one selected flavor. For example, when a user selects flavors (or no flavors) and a type of water to be dispensed and causes the selected beverage to be dispensed, the beverage dispenser 22 may inform the server of the user ID of the user, the selected flavors, the type of water, and the volume of the beverage that was dispensed. The beverage dispenser 22 may also provide to the server 25 a cost of the flavor mixture that was dispensed per unit of volume.

Upon receiving this information, the server may generate a bill against a user's account that is associated with the received user ID. In this way, the beverage dispenser 22 may allow a user to purchase a beverage from a beverage dispenser 22 without touching anything except their mobile device 22 (e.g., a mobile phone or tablet) and the container that the requested beverage is dispensed into.

The beverage dispenser system allows a company to bill users automatically and to provide reports detailing usage of the beverage dispenser(s). For example, a university may have a meal plan that allows students to purchase a certain dollar amount of beverages each month and the university may have multiple beverage dispensers 22 spread across the university. A student may use any one of the beverage dispensers 22 via their mobile phone and the beverage dispenser system 20 may track student usage and provide notifications when the student approaches their dollar allotment for a given time period.

The server may also provide a report to users detailing the beverages, volumes of fluid, and optionally nutritional information of the beverages consumed. This report may be provided to a service that the user is a member of (e.g., Fitbit, Apple Health, etc.).

The control system 24 may further include at least one sensor 60 that is communicatively coupled with the processor 48 for automatically controlling the levels of the liquid, the flavored product, and the liquid additive. More than one sensor may be used and at least one sensor 60 may be arranged in the mixture outlet 28 of the mixing receptacle 26. Any suitable type of sensor 60 may be used including fluid level, pressure, temperature or thermometer, potentiometer, conductivity, biosensors, and optical sensors. Other types of sensors may be suitable such as any sensor that is configured to measure temperature, pH, acidity, water activity, or other conditions such as those that control or prevent undesirable microorganisms in the beverage product.

Arranging the sensor 60 in the mixture outlet 28 ensures that the enhanced flavored mixture to be dispensed has the desired amount of ingredients and the control system 24 may be configured to adjust the amounts based on the conditions detected by the sensor 60. In exemplary embodiments, the mixture control valve 42 may be opened, closed, or partially opened or closed during adjustment. In other exemplary embodiments, a recirculation line may be provided such that if the sensor 60 detects that a enhanced flavored mixture in the mixture outlet 28 does not satisfy a predetermined threshold for a particular condition, the enhanced flavored mixture may be rerouted back to the mixing receptacle 26 for further mixing. The recirculation line may include any valving, pumps, or fluid lines for recirculating the undesirable enhanced flavored mixture.

Figure 7:
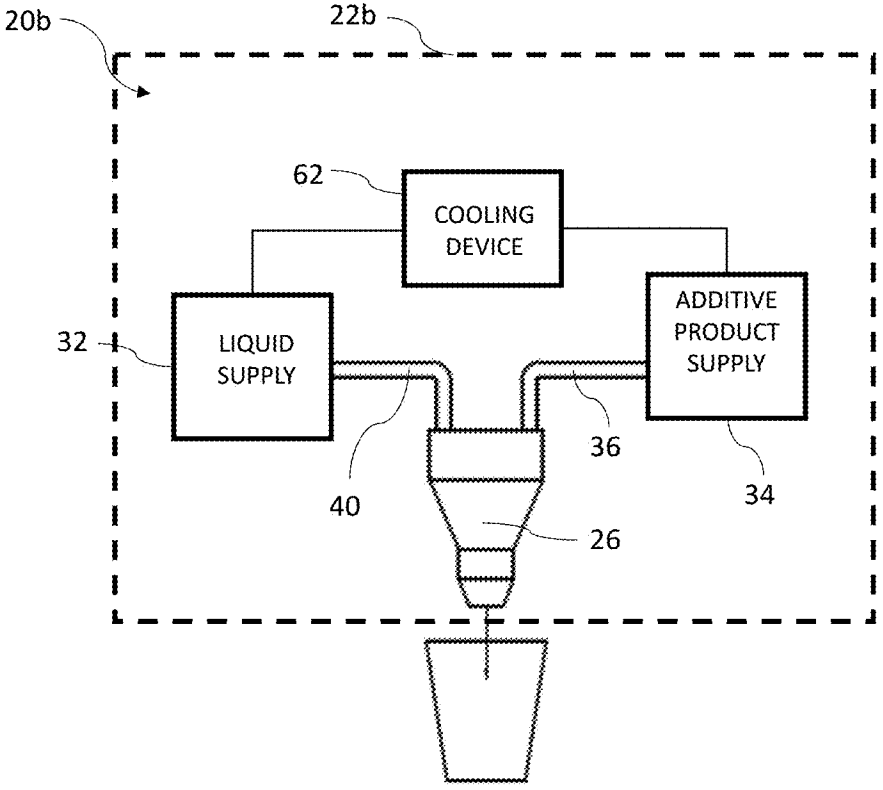
FIG. 7 is a schematic drawing showing the beverage dispenser of FIG. 4 according to another exemplary embodiment in which a liquid supply line and an additive product supply are cooled.

Referring now to FIG. 7, another exemplary embodiment of the beverage dispensing system 20*b* is shown in which the beverage dispenser 22*b* is configured to use at least one of a cooled liquid or a cooled flavored product supply. The beverage dispensing system 20*b* may include at least one cooling device 62 which includes a single cooling device or two separate cooling devices for the liquid and the flavored product(s). In an exemplary embodiment, the cooling device 62 may be fluidly connected to the supply line 40 for cooling the liquid as the liquid travels from the liquid enclosure 32 to the mixing receptacle 26. The cooling device 62 may be configured to cool the liquid, such as water, to a temperature that is between 1 and 8 degrees Celsius (between 35 and 45 degrees Fahrenheit). The cooling temperature may be dependent on the liquid and the temperature may be dependent on whether the liquid is being stored or moving toward the mixing receptacle 26. To maintain cool temperatures, a supply line may be thermally insulated.

The same cooling device 62 (or a second cooling device) may also be provided for the flavored product. The cooling device 62 may also be fluidly connected to the product enclosure 34 or to the supply line 36. The cooling devices 62 may be configured to maintain a predetermined temperature of the liquid and/or the flavored product during storage and during operation. In exemplary embodiments, only the cooling device 62 for the liquid may be provided such that only the liquid is cooled. Any suitable cooling device or components may be used to cool the liquid or the flavored product, including heat exchangers, desiccants, insulators, evaporators, condensers, compressors, expansion valves, cooling fans, etc.

Figure 8:
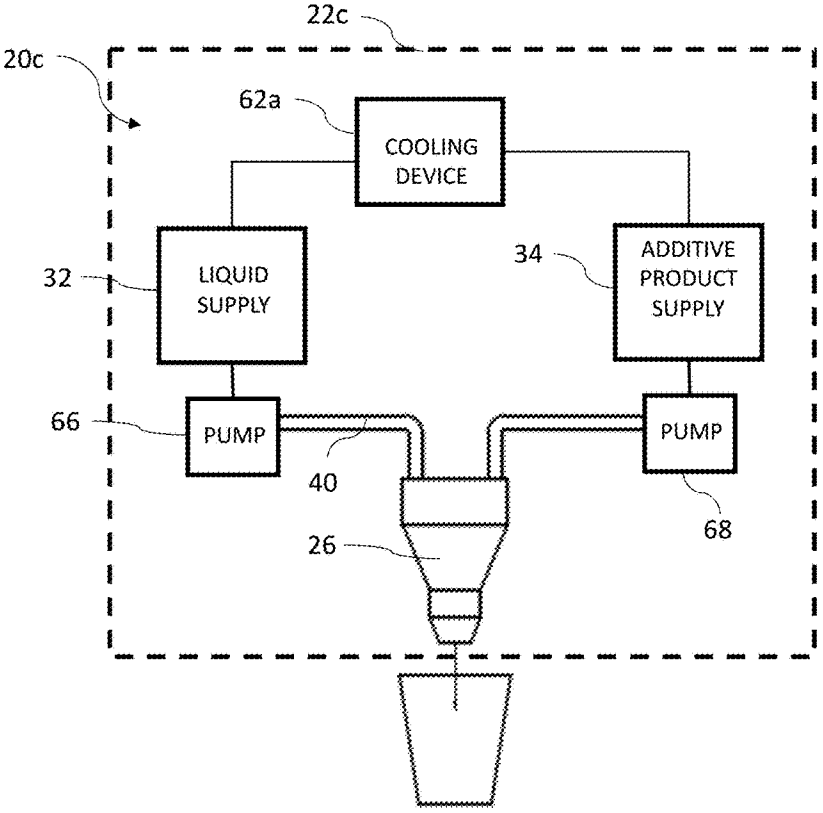
FIG. 8 is a schematic drawing showing the beverage dispenser of FIG. 4 according to another exemplary embodiment in which the liquid supply line and the additive product supply are cooled and pumped to a mixing receptacle of the beverage dispenser.

Referring in addition to FIG. 8, still another embodiment of the beverage dispensing system 20*c* is shown in which the beverage dispenser 22*c* further includes pumps 66, 68 for pumping the materials from the liquid enclosure 32 and the product enclosure 34 to the mixing receptacle 26. As shown in the exemplary embodiment of FIG. 8, the cooling device 62*a* for the liquid may be fluidly connected to the liquid enclosure 34 rather than the supply line 40. In still other exemplary embodiments, cooling devices may be fluidly connected to both the enclosures and the supply lines for the liquid and/or the flavored product.

Figure 9:
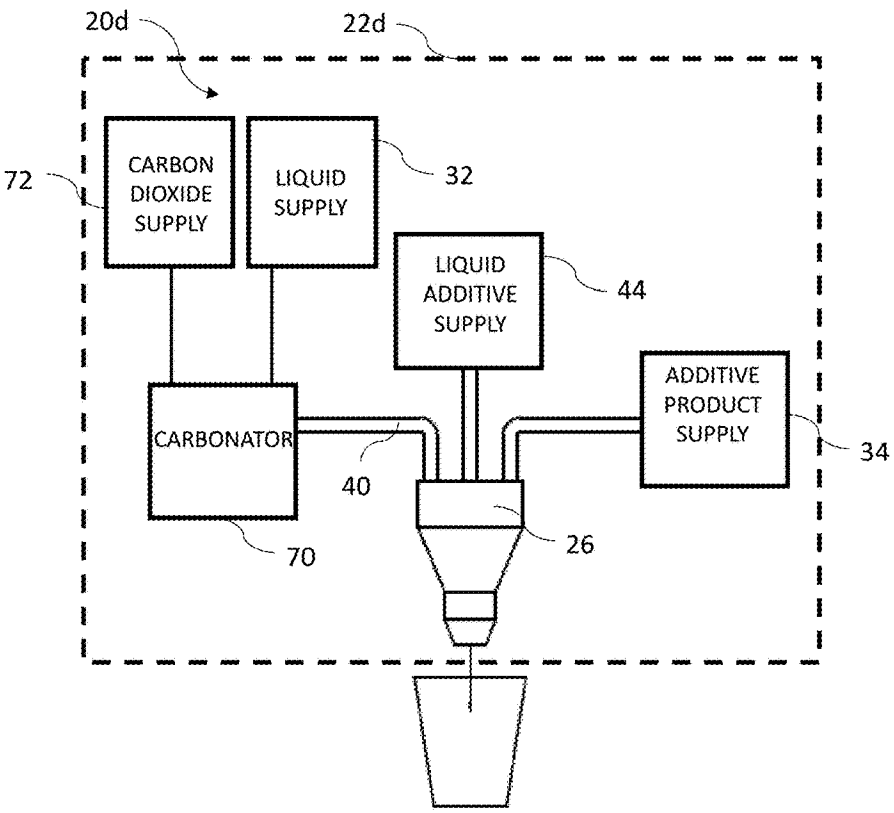
FIG. 9 is a schematic drawing showing the beverage dispenser of FIG. 4 according to another exemplary embodiment in which the liquid supply is carbonated.

Referring now to FIG. 9, still another embodiment of the beverage dispensing system 20*d* is shown in which the beverage dispenser 22*d* further includes a carbonator 70 for carbonating the liquid from the liquid enclosure 32. The carbonator 70 is fluidly connected to a carbon dioxide supply 72 and the liquid enclosure 32 such that the carbonator 70 is configured to receive the liquid from the liquid enclosure 32. The supply line 40 is fluidly connected to the carbonator 70 for transferring the carbonated liquid to the mixing receptacle 26 for mixing with the flavored product received from the product enclosure 34. In exemplary embodiments, liquid additive may also be mixed in. The carbonator 70 may include any suitable valves or control lines and a control system for the beverage dispenser 22*d* may also be configured to operate the carbonator 70.

Figure 10:
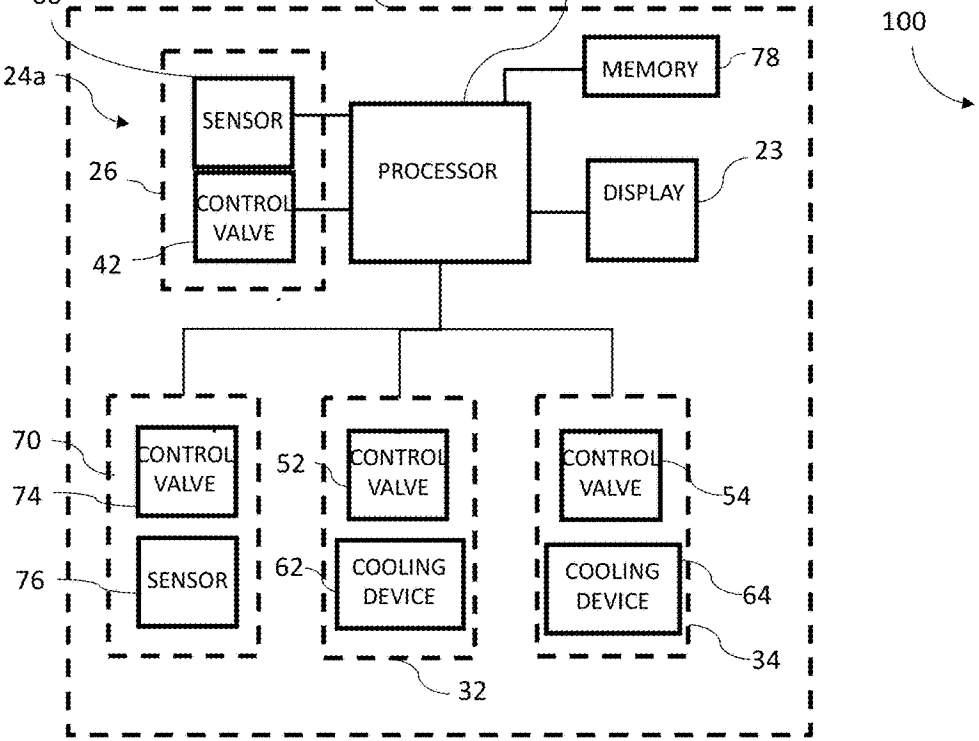
FIG. 10 is a schematic drawing showing another exemplary control system for controlling a beverage dispenser.

Referring in addition to FIG. 10, an exemplary control system 24*a* is shown in a beverage dispenser 22*e* that includes the carbonator 70 having a control valve 74 and a sensor 76, the liquid enclosure 32 including the liquid control valve 52 and the cooling device 62, the product enclosure 34 including the control valve 54, and the mixture control valve 42 arranged in the mixing receptacle 26. The control system 24*a* operates similarly to the control system 24 of FIG. 6 and the configurations shown in FIGS. 3 and 7 are merely exemplary. More or fewer components of the beverage dispenser may be included and the components may depend on the application. For example, the carbonator 70 may be provided without one or any of the cooling devices and/or the liquid additive enclosure 44 shown in the control system 24 of FIG. 6 may be provided. The control system 24*a* includes the processor 48, the user input 58, and the controller 50 that is communicatively coupled with the carbonator 70, the liquid enclosure components 52, 62, and the flavored product components 54.

The control system 24*a* is configured to control the control valves 42, 52, 54, 74 and the cooling device 62. The sensors 60, 76 may be used to detect certain conditions and the processor 48 may be used to operate the controller 50 based on the detected conditions. The control system 24*a* may be configured for automatic operation and/or may also receive manual inputs from the user input 58. A memory 78 may also be provided in the control system 24*a* for containing stored data pertaining to recipes for particular enhanced beverage flavored mixtures. The stored data may also pertain to predetermined conditions or thresholds for the sensors. Examples of predetermined conditions or thresholds may include fluid levels, pressure, temperature, viscosity, etc. The processor 48 is communicatively coupled to the memory 78 and may provide instructions to the control valves and/or other components based on comparing the detected data and the stored data.

Figure 11:
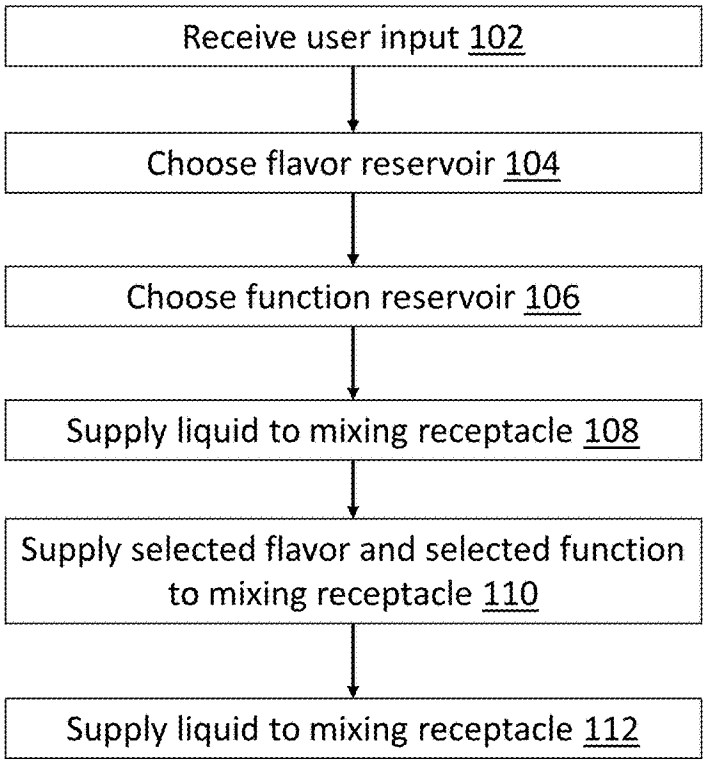
FIG. 11 is a schematic drawing showing a flowchart for a method of controlling an amount of a flavored product in a flavored mixture of the flavored product and a liquid that is dispensed from a beverage dispenser.

Referring now to FIG. 11, a flow chart shows a method 100 of controlling an amount of a flavored product and a functional product in an enhanced flavored mixture. The method 100 may include using the beverage dispenser 22, 22*a*, 22*b*, 22*c*, 22*d*, 22*e* shown in FIGS. 4-10. A first step 102 of the method 100 includes receiving user input including a selected flavor and a selected function.

A second step 104 of the method 100 includes choosing from multiple selectable reservoirs a flavor reservoir based on the selected flavor. Similarly, in a third step 106, a function reservoir is chosen from the multiple selectable reservoirs based on the selected function. A fourth step 108 of the method 100 includes supplying the liquid to the mixing receptacle by using the circuitry to control the liquid control valve based on the received user input. Similarly, in the fifth step 110, the selected flavor from the flavor reservoir and the selected function from the function reservoir are supplied to the mixing receptacle to be dissolved in the liquid and to form an enhanced flavored mixture by using the circuitry to control a mixture control valve based on the received user input.

In the sixth step 106 of the method 100, an amount of the selected flavor and the selected function that is dissolved in the liquid is modulated to maintain a predetermined solution of the enhanced flavored mixture that is dispensed from the beverage dispenser by using the circuitry to control a control valve based on the received user input.

Step 108 may include cooling the liquid such as by using the cooling device 62, 62*a* shown in FIGS. 4 and 5. Step 108 may further include carbonating the liquid and supplying the carbonated liquid to the mixing receptacle 26, such as by using the carbonator 70 shown in FIG. 9.

Steps 108 and 110 may include storing the liquid and the additive product, and using supply lines, pumps, etc. to transfer the material to the mixing receptacle 26. Supplying the additive product may include supplying a powder material, a liquid, or a solution thereof and supplying the liquid may include supplying at least one of water, carbonated water, syrup, soda, tea, coffee, or a combination thereof.

Step 112 of the method 100 may include controlling an amount of the additive product that is dissolved in the liquid. Step 112 may include using the control system 24, 24*a* shown in FIGS. 6 and 10. For example, control valves, such as the control valves 42, 52, 54, 74 shown in FIG. 10 may be operated based on sensed conditions to achieve a specific beverage enhanced flavored mixture. In exemplary embodiment in which the liquid additive enclosure 44 of FIG. 5 is provided, step 116 may include controlling an amount of the liquid additive that is added to the enhanced flavored mixture. Controlling the liquid additive may include using the control valve 56 shown in FIG. 6. When the enhanced flavored mixture has the desired solution, step 112 of the method 100 includes dispensing the enhanced flavored mixture. For example, the enhanced flavored mixture may be dispensed into the consumption container 30 shown in FIG. 4.

Step 112 of the method 100 includes optionally maintaining a predetermined solution of the enhanced flavored mixture. The control system 24, 24*a* may be configured to automatically maintain the solution by determining a level of the flavored product in the mixing receptacle 26 using a product level sensor 60, as shown in FIGS. 3 and 7, and controlling the control valves 42, 52, 54, 74 based on the determined level. Maintaining the solution may include maintaining the solution to have between 15 and 25 milligrams of the flavored product per 240 milliliters of the enhanced flavored mixture. Other solutions may also be suitable and are dependent on the beverage product.

Using the beverage dispenser, system, and method described herein is advantageous in both producing a beverage enhanced flavored mixture using a separate mobile device that does not require a user to physically touch the beverage dispenser.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A control system for a beverage dispenser for dispensing a flavored beverage and having a display and multiple selectable reservoirs, wherein the control system comprises circuitry configured to:

cause the display to display a user interface having a flavor selection area and a function selection area, wherein:

the flavor selection area includes multiple selectable flavors; and the function selection area includes multiple selectable functions;

receive user input identifying a selected flavor from the flavor selection area of the user interface;

receive user input identifying a selected function from the function selection area of the user interface;

choose from the multiple selectable reservoirs a flavor reservoir based on the selected flavor;

choose from the multiple selectable reservoirs a function reservoir based on the selected function;

cause the beverage dispenser to generate an enhanced flavored mixture by adding to a liquid the selected flavor from the flavor reservoir and the selected function from the function reservoir; wherein a concentration of a dietary supplement included in the selected function that is included in the enhanced flavored mixture is at least five times larger than a concentration of the dietary supplement included in the selected flavor that is included in the enhanced flavored mixture; and cause the beverage dispenser to dispense the enhanced flavored mixture.

2. The control system of claim 1, wherein the selectable functions include at least one of relax, energize, immunize, or muscle.

3. The control system of claim 2, wherein:

when the selected function is relax, the circuitry is configured to choose as the function reservoir one of the multiple selectable reservoirs including at least one of cannabidiol (CBD), *Rhodiola rosea*, melatonin, glycine, ashwagandha, L-theanine, B vitamins, or kava;

when the selected function is energize, the circuitry is configured to choose as the function reservoir one of the multiple selectable reservoirs including at least one of caffeine, coenzyme Q10 (CoQ10), B vitamins, iron, creatine, citrulline, *Rhodiola rosea*, or ashwagandha;

when the selected function is immunity, the circuitry is configured to choose as the function reservoir one of the multiple selectable reservoirs including at least one of vitamin C, B vitamins, vitamin E, vitamin A, vitamin D, folate, folic acid, iron, selenium, zinc, elderberry, echinacea; and when the selected function is muscle, the circuitry is configured to choose as the function reservoir one of the multiple selectable reservoirs including at least one of protein or creatine.

4. The control system of claim 2, wherein the selectable functions include relax, energize, and immunize.

5. The control system of claim 1, wherein the selected function included in the enhanced flavored mixture includes a dietary supplement in a quantity that is greater than or equal to 50% of a daily Recommended Dietary Allowances (RDA) for the dietary supplement.

6. The control system of claim 1, wherein the circuitry is further configured to cause the display to display a water selection user interface for selecting the liquid, wherein the water selection user interface includes multiple selectable water types.

7. The control system of claim 6, wherein the water selection user interface is displayed after the circuitry receives the selected flavor and the selected function.

8. The control system of claim 6, wherein the selectable water types of the water selection user interface include sparkling water and still water.

9. A control system for a beverage dispenser for dispensing a flavored beverage, the beverage dispenser comprising:

a liquid enclosure that includes a liquid control valve and that is configured to contain a liquid;

a mixing receptacle that is fluidly connected with the liquid control valve and includes a mixture outlet and a mixture control valve;

a product enclosure for storing multiple additive products including at least multiple selectable flavors and multiple selectable functions, the product enclosure including multiple selectable reservoirs each containing one of the additive products separately from the liquid and an additive control valve configured to control release of the additive products from the multiple selectable reservoirs, wherein the additive control valve is fluidly connected to the mixing receptacle for mixing at least one of the additive products with the liquid to form an enhanced flavored mixture that is dispensed from the mixture outlet and the mixture control valve; and a display including a user interface for receiving beverage selections from a user, wherein:

the user interface includes a flavor selection area and a function selection area;

the flavor selection area includes multiple selectable flavors, each of the multiple selectable flavors being associated with one of the multiple selectable reservoirs; and the function selection area includes multiple selectable functions, each of the multiple selectable functions being associated with one of the multiple selectable reservoirs; and wherein:

the control system comprises circuitry configured to:

cause the display to display the user interface having the flavor selection area and the function selection area;

receive user input identifying a selected flavor from the flavor selection area of the user interface;

receive user input identifying a selected function from the function selection area of the user interface;

choose from the multiple selectable reservoirs a flavor reservoir based on the selected flavor;

choose from the multiple selectable reservoirs a function reservoir based on the selected function;

cause the beverage dispenser to generate an enhanced flavored mixture by adding to the liquid the selected flavor from the flavor reservoir and the selected function from the function reservoir;

cause the beverage dispenser to dispense the enhanced flavored mixture; and control the liquid control valve and the additive control valve to modulate an amount of the selected flavor from the flavor reservoir and the selected function from the function reservoir in the dispensed flavored mixture based on the received beverage selections.

10. The beverage dispenser of claim 9, wherein the selectable functions include at least one of relax, energize, immunize, or muscle.

11. The beverage dispenser of claim 10, wherein:

when the selected function is relax, the circuitry is configured to choose as the function reservoir one of the multiple selectable reservoirs including at least one of cannabidiol (CBD), *Rhodiola rosea*, melatonin, glycine, ashwagandha, L-theanine, B vitamins, or kava;

when the selected function is energize, the circuitry is configured to choose as the function reservoir one of the multiple selectable reservoirs including at least one of caffeine, coenzyme Q10 (CoQ10), B vitamins, iron, creatine, citrulline, *Rhodiola rosea*, or ashwagandha;

when the selected function is immunity, the circuitry is configured to choose as the function reservoir one of the multiple selectable reservoirs including at least one of vitamin C, B vitamins, vitamin E, vitamin A, vitamin D, folate, folic acid, iron, selenium, zinc, elderberry, echinacea; and when the selected function is muscle, the circuitry is configured to choose as the function reservoir one of the multiple selectable reservoirs including at least one of protein or creatine.

12. The beverage dispenser of claim 10, wherein the selectable functions include relax, energize, and immunize.

13. The beverage dispenser of claim 9, wherein a concentration of a dietary supplement included in the selected function that is included in the enhanced flavored mixture is at least five times larger than a concentration of the dietary supplement included in the selected flavor that is included in the enhanced flavored mixture.

14. The beverage dispenser of claim 9, wherein the selected function included in the enhanced flavored mixture includes a dietary supplement in a quantity that is greater than or equal to 50% of a daily Recommended Dietary Allowances (RDA) for the dietary supplement.

15. A method of controlling an amount of a flavored product and a functional product in a flavored mixture of the flavored product, the functional product, and a liquid that is dispensed from a beverage dispenser, the method comprising:

receiving user input from a display of the beverage dispenser including a user interface, the user input identifying a selected flavor and a selected function, wherein the user input is received by a control system including circuitry configured to display the user interface; wherein the user interface has a flavor selection area and a function selection area; wherein the flavor selection area includes multiple selectable flavors and the function selection area includes multiple selectable functions;

choosing from multiple selectable reservoirs a flavor reservoir based on the selected flavor;

choosing from the multiple selectable reservoirs a function reservoir based on the selected function;

supplying a liquid to a mixing receptacle by using the circuitry to control a liquid control valve based on the received user input;

supplying the selected flavor from the flavor reservoir and the selected function from the function reservoir to the mixing receptacle to be dissolved in the liquid and form an enhanced flavored mixture by using the circuitry to control a mixture control valve based on the received user input; wherein a concentration of a dietary supplement included in the selected function that is included in the enhanced flavored mixture is at least five times larger than a concentration of the dietary supplement included in the selected flavor that is included in the enhanced flavored mixture; and modulating an amount of the selected flavor and the selected function that is dissolved in the liquid to maintain a predetermined solution of the enhanced flavored mixture that is dispensed from the beverage dispenser by using the circuitry to control a control valve based on the received user input.

16. The method of claim 15, wherein the selectable functions include at least one of relax, energize, immunize, or muscle.

17. The method of claim 16, wherein:

when the selected function is relax, using the circuitry to choose as the function reservoir one of the multiple selectable reservoirs including at least one of cannabidiol (CBD), *Rhodiola rosea*, melatonin, glycine, ashwagandha, L-theanine, B vitamins, or kava;

when the selected function is energize, using the circuitry to choose as the function reservoir one of the multiple selectable reservoirs including at least one of caffeine, coenzyme Q10 (CoQ10), B vitamins, iron, creatine, citrulline, *Rhodiola rosea*, or ashwagandha;

when the selected function is immunity, using the circuitry to choose as the function reservoir one of the multiple selectable reservoirs including at least one of vitamin C, B vitamins, vitamin E, vitamin A, vitamin D, folate, folic acid, iron, selenium, zinc, elderberry, echinacea; and when the selected function is muscle, using the circuitry to choose as the function reservoir one of the multiple selectable reservoirs including at least one of protein or creatine.

18. The method of claim 15, wherein the selected function includes a dietary supplement in a quantity that is greater than or equal to 50% of a daily Recommended Dietary Allowances (RDA) for the dietary supplement.

* * * * *